United States Patent [19]

Reed, Jr. et al.

[11] 4,385,948

[45] May 31, 1983

[54] IN SITU CURED BOOSTER EXPLOSIVE

[75] Inventors: Russell Reed, Jr.; May L. Chan; Horace D. Stanton, all of Ridgecrest, Calif.

[73] Assignee: The United States of America as represented by the Secretary of the Navy, Washington, D.C.

[21] Appl. No.: 176,172

[22] Filed: Aug. 7, 1980

[51] Int. Cl.[3] ..... C06B 45/10

[52] U.S. Cl. ..... 149/19.5; 149/11; 149/19.6; 149/19.92; 149/92; 264/3 R

[58] Field of Search ..... 149/19.5, 11, 19.6, 149/19.92, 92; 264/3 R

[56] References Cited

U.S. PATENT DOCUMENTS

| | | | |
|---|---|---|---|
| 3,348,986 | 10/1967 | Sauer | 264/3 R |
| 3,490,967 | 1/1970 | Rhodes et al. | 149/19.6 |
| 3,756,874 | 9/1973 | Chang et al. | 149/19 |
| 3,834,957 | 9/1974 | McDevitt et al. | 149/19.5 |
| 3,880,683 | 4/1975 | Voreck et al. | 149/19.92 |
| 3,888,707 | 6/1973 | Rothenstein | 149/19.4 |
| 3,948,698 | 4/1976 | Elrick et al. | 149/19.6 |
| 4,090,894 | 5/1978 | Reed et al. | 264/3 R |
| 4,091,729 | 5/1978 | Bell et al. | 149/19.4 |
| 4,163,681 | 8/1979 | Rothenstein et al. | 149/19.6 |

FOREIGN PATENT DOCUMENTS

| | | | |
|---|---|---|---|
| 1283691 | 8/1972 | United Kingdom | 149/19.4 |

*Primary Examiner*—Edward A. Miller

*Attorney, Agent, or Firm*—W. F. Beers; W. Thom Skeer; B. H. Cottrell

[57] ABSTRACT

The present invention relates to a method for preparing an in situ cured booster explosive by mixing explosive crystals with a prepolymer solution comprising a carboxyl (or hydroxyl)-terminated hydrophobic polyester and epoxidized linseed oil with chromium octanoate as a catalyst. The explosive mixture is pressed into desired size and cured at 60° C. to 70° C. for about 96 hours. The resulting in situ cured explosive has desirable safety and physical properties.

6 Claims, No Drawings

IN SITU CURED BOOSTER EXPLOSIVE

BACKGROUND OF THE INVENTION

1. Field of the Invention

This invention provides for a method for making pressed explosives which are less hazardous and more desirable than those presently used.

2. Description of the Prior Art

Some previous pressed explosives use wax as a binder and are difficult to manufacture. The resulting pellets tend to fracture when handled, and a high percentage of these are rejected for being out of specification.

Other pressed explosives use fluoroelastomers (Viton) or tetrafluoroethylenes (Teflon) as binders. Viton and Teflon are expensive and the resulting explosives tend to detonate when subjected to cook-off tests.

There is a need for a safer explosive, that employs a tough inexpensive binder, and which does not readily detonate.

SUMMARY OF THE PRESENT INVENTION

The present invention relates to a method for preparing an in situ cured booster explosive by coating an explosive filler with a prepolymer binder that is rubbery and pliable and desensitizes the explosive by binding together the particles of explosive filler to form a tough composite explosive. The coated explosive is pressed into pellets or billets and cured at 60°–70° C. for about 96 hours.

OBJECTS OF THE PRESENT INVENTION

One object of the present invention is to make a pressed explosive safer than those made in the previous art.

Another object is to make a pressed explosive that does not fracture when handled.

Still another object is to make an explosive from low cost materials which are readily available.

And finally, an object is to produce an explosive having high quality, and excellent reliability, and superior physical properties.

These objects and other features of the present invention are illustrated in the following detailed description, and are not found in the previous art.

DESCRIPTION OF THE PREFERRED EMBODIMENTS

A method for preparing an in situ cured booster explosive is described by the following example:

About 90 percentage (%) to about 97 percentage (%) by weight of 1,3,5-trinitro-1,3,5-triazocyclohexane explosive filler crystals also known as cyclotrimethylenetrinitramine or RDX (Class A, Type II) are coated with liquid prepolymer binder composed of about 2.30% to about 7.66% by weight of carboxyl-terminated poly- 1,6-hexanediol dimerate (2000 molecular weight and with about 0.70% to about 2.34% by weight of epoxidized vegetable oil such as Epoxol 9–5, also known as epoxidized linseed oil, and adding about 0.3% by weight of chromium octanoate as a cure catalyst.

The coating technique for large scale preparations comprises adding 0.3 liters of n-hexane to each kilogram of the RDX and binder composition and then slowly mixing for about a half hour. The excess n-hexane is removed by applying a vacuum during the mixing process.

The resulting mixture is a powder ready for pressing into either pellets (0.5 inches diameter by 1 inch height) or into larger billets (3 inches diameter by 5 inches height). The pressing is accomplished at room temperature (about 70° F.) under 25,000 pounds per square inch (psi) for about 60 seconds.

Alternatively, different qualities of the explosive may be obtained by varying the amounts of binder and explosive. Explosives other than RDX can be used, as well as other carboxyl-terminated or hydroxyl-terminated hydrophobic polyesters as binders. If a hydroxyl-terminated polymer binder is used, it is cured with dimeryl dissocyanate. Possible binders are listed in Table I.

TABLE I

Possible Binders hydroxyl or carboxyl terminated prepolymers yielding a rubbery pliable coating:

polybutadiene
polyether

TABLE I polypropylene gycol
polyethylene glycol (plasticized) polyesters
(4–20) aliphatic or cycloaliphatic dicarboxylic acids esterified with diols or triols typically 1,6-hexanediol or polyethylene gycols
dimer acid plus diols and triols
neopentyl glycol
1,6-hexanediol
$\alpha,\omega$-dihydroxyalkanes Table II lists the comparative physical properties of in situ cured booster explosives. The example previously cited has excellent qualities for use in ordnance. Polymer formation and consequent toughening occurs during curing, preventing cracking of the coating, and samples scanned under an electron microscope reveal homogeneous coating.

Furthermore the tests show that the example cited is superior in resistance to abrasion, friction, and impact and is equivalent in electrostatic and thermal stability when compared to conventional explosives such as CH-6.

TABLE II

COMPARATIVE PROPERTIES OF BOOSTER EXPLOSIVES

| | A-1-a | A-2-a | D-1 | A-4 | CH-6 | PBXN6 |
|---|---|---|---|---|---|---|
| Nominal Composition Weight % RDX/Binder | 95/5 | 95/5 | 95/5 | 97/3 | 98.5/1.5 | 95/5 |
| Impact Sensitivity 50% pt. cm 2.5 Kg Wt. | 26 | 25 | 23 | 23 | 21 | 21 |
| Friction Sensitivity | 794 | 589 | 692 | 486 | 479 | 741 |

TABLE II-continued

| COMPARATIVE PROPERTIES OF BOOSTER EXPLOSIVES | | | | | | |
|---|---|---|---|---|---|---|
| | A-1-a | A-2-a | D-1 | A-4 | CH-6 | PBXN6 |
| 50% pt (lbs) ABL sliding friction test Allegheny Ballistic Lab. | | | | | | |
| Electrostatic (Spark) Sensitivity 0.25 Joules | 10/10NF | 10/10NF | 10/10NF | | 10/10NF | 10/10NF |
| Vacuum Thermal Stability 100° C. ml/gm/48 hrs. Vol. of Gas measured as ml of/gas/gm/48 hrs. | 0.06 | 0.11 | 0.24 | 0.07 | 0.08 | 0.05 |
| Abrasion test Weight loss % | 1.1 | 2.3 | 3.5 | 14.2 | 23.5 | 2.3 |
| Pressed Density gm/cc | 1.65 | 1.64 | 1.66 | 1.685 | 1.702 | 1.758 |

*NF, no fire
A-1-a: RDX/poly 1,6-hexanediol dimerate cured with Epoxol 9-5 (95/5)
A-2-a: RDX/carboxyl terminated polybutadiene cured with Epoxol 9-5 (95/5)
D-1: RDX/R45HT cured with dimeryl diisocyanate, retarded with n-octyl salicylate (95/5)
A-4: RDX desensitized with wax
CH-6: RDX desensitized with wax
PBXN6: RDX desensitized with Viton It is a relatively safe explosive, in view of the following considerations:

The uniform and adherant polymeric binder coating of this explosive is able to remove heat more efficiently (by endothermic dissociation and vaporization) from a decomposing particle of explosive filler than are waxes which melt and flow away from the filler surface. Fluorocarbon polymers are not efficient in this regard since they decompose at temperatures well above the decomposition of RDX and common explosive fillers.

Partial curing of the molding powder prior to pressing and final curing can further improve the quality and adhesiveness of the binder on the RDX crystals, which further decreases the explosive's sensitivity.

Furthermore, solvents other than n-hexane can be used as a coating media.

TABLE III

Equivalent Ratios

The preferred equivalent ratio of epoxy to carboxyl terminated resin is 1.5. However, it can be varied from 1.1 to 1.8.

At the ratio of 1.5 the weight % of Epoxol 9-5 is 23.45 and carboxyl resin is 76.55.

At the ratio of 1.1 weight % Epoxol is 17.19 and Carboxyl resin is 82.81%.

TABLE III (Continued)

At the ratio of 1.8 the weight % Epoxol is 28.14 and the carboxyl resin is 71.86.

These wide ranges of composition can be attained because of the high functionality of the Epoxol 9-5 (f>4).

| | Weight % | |
|---|---|---|
| E/C | Epoxy | Carboxyl |
| 1.1 | 17.19 | 82.81 |
| 1.5 | 23.45 | 76.55 |
| 1.8 | 28.14 | 71.88 |

The advantages and new features of the present invention are apparent from the preceding description.

It is made from low cost materials that are readily available, and provides for a safer explosive with superior physical quantities.

The foregoing illustrates to one skilled in the art, the methods for preparing the present invention, and its properties. However, this invention is not limited by its description but only by the claims.

What is claimed is:

1. An in situ cured explosive comprising:
cyclotrimethylenetrinitramine;
carboxyl-terminated poly-1,6-hexanediol dimerate;
epoxidized vegetable oil; and
a cure catalyst.

2. An in situ explosive as in claim 1 wherein said epoxidized vegetable is epoxidized linseed oil.

3. An in situ cured explosive as in claim 2 wherein said cure catalyst is chromium octanoate.

4. An in situ cured explosive as in claim 3 wherein said explosive on a percent by weight basis comprises:
from 90 to 97 percent cyclotrimethylenetrinitramine;
from 2.30 to 7.66 percent carboxyl-terminated poly-1,6-hexanediol dimerate;
from 0.70 to 2.34 percent epoxidized linseed oil; and
about 0.3 percent chromium octanoate.

5. A method for preparing an in situ cured booster explosive comprising the steps of:
mixing a solvent, cyclotrimethylenetrinitramine, and a binder comprising carboxyl-terminated poly-1,6-hexanediol dimerate, epoxidized vegetable oil and chromium octanoate for about a half hour to form a coated explosive;
evaporating said solvent excess;
pressing said coated explosive at about 25,000 pounds per square inch (psi) for about 60 seconds at 70° F.; and
curing said pressed coated explosive from about 60° C. to about 70° C. for about 96 hours.

6. A method for preparing an in situ cured booster explosive as in claim 5 wherein said mixing step comprises mixing a solvent, from about 90 to 97 percent by weight cyclotrimethylenetrinitramine, from about 2.30 to 7.66 percent by weight carboxyl-terminated poly-1,6-hexanediol dimerate, from about 0.70 to 2.34 percent by weight epoxidized linseed oil as said epoxidized vegetable oil and about 0.3 percent by weight chromium octanoate.

* * * * *